US005885053A

United States Patent [19]

Deye

[11] Patent Number: 5,885,053

[45] Date of Patent: Mar. 23, 1999

[54] CONTAINER FOR TRANSPORTING AND PLACING FLOWABLE MATERIAL

[75] Inventor: Martin Joseph Deye, Covington, Ky.

[73] Assignee: J.S. Solutions, Inc., Granger, Ind.

[21] Appl. No.: 647,560

[22] Filed: May 14, 1996

[51] Int. Cl.[6] ..... E02F 3/00

[52] U.S. Cl. ..... 414/722; 414/725; 222/558

[58] Field of Search ..... 414/607, 608, 414/722, 725, 912, 920; 222/256, 258; 220/908, 656–659, 213; 141/108, 339

[56] References Cited

U.S. PATENT DOCUMENTS

| | | | |
|---|---|---|---|
| 1,649,941 | 11/1927 | Winser, Jr. | 222/558 |
| 1,655,021 | 1/1928 | Nord | 141/339 X |
| 4,068,771 | 1/1978 | Zimmerman | 414/722 X |
| 5,004,022 | 4/1991 | Carlsson | 141/108 X |
| 5,182,057 | 1/1993 | Johnson | 414/725 X |

*Primary Examiner*—Donald W. Underwood
*Attorney, Agent, or Firm*—Randall J. Knuth

[57] ABSTRACT

A container for transporting and placing materials, such as concrete, grains, landscaping material, etc. includes a container mounted on a mounting plate of a skid steer loader so that the container may be raised and lowered by using the lift arms of the loader and may be pivoted relative to the lift arms. The container includes an open top defining a fill opening for receiving the material to be dispensed. The rear wall of the container includes appropriate brackets to the mounting plate of the loader, and the front wall includes a dispensing opening and chute, leading from the opening and a manually operable gate for controlling flowing material through the chute. The front wall also includes converging sections which cooperate with the dispensing opening to define a funnel directing flowing material through the dispensing opening.

2 Claims, 5 Drawing Sheets

CONTAINER FOR TRANSPORTING AND PLACING FLOWABLE MATERIAL

This invention relates to apparatus for transporting and placing flowable materials.

Concrete is usually transported to a job site in a large mixer truck. Ideally, the truck can be driven to the place where concrete is to be placed and then discharged from the truck directly into the forms where the concrete is to be placed. However, it is often impossible to drive the trucks close to the place where the concrete is to be placed. In this case, the concrete is discharged from the mixer truck into a wheelbarrow or concrete buggy which must then be manually pushed to the place where the concrete is to be placed. Clearly, if manual placement is required, the time required to place the concrete is increased significantly and the labor costs involved are similarly increased.

Small skid steer loaders are commonly available at construction job sites. These small loaders are extremely maneuverable and may be driven almost any place that a wheelbarrow or concrete buggy may be maneuvered. Certainly, small skid steer loaders are easily driven and maneuvered into places where large concrete mixer trucks cannot possibly be driven. The present invention provides a container for attachment to the lift arms of a small skid steer loader. Accordingly, the container may be raised, lowered, or tilted by operating the appropriate controls of the skid steer loader in a conventional manner. An open top of the container defines a fill opening which may receive concrete discharged directly from the mixer truck.

An important aspect of the invention is that a discharge opening and a chute are provided on the side of the container away from the side that is attached to the lift arms of the skid steer loader. This front wall of the container is provided with converging side walls which act as a funnel directing concrete through the opening and chute. Accordingly, when the container is tilted to place concrete, the weight of the concrete within the container is concentrated in a direction forcing the weight of the concrete within the container in a direction forcing concrete through the discharge opening and chute. A gate pivotally mounted on the chute may be easily opened and closed by a workman directing the flow of concrete. The gate has a curved surface which meets with a correspondingly curved surface on the chute, which acts as a baring permitting the gate to be easily opened and closed to initiate and terminate flow of concrete through the chute.

Although the invention has been described as a device for transporting concrete, the container and skid steer loader may also be used to transport and place any other flowable material. For example, it is often necessary in agricultural operations to transport grain and place the grain in feeding containers for animals. The container of the present invention facilitates this operation, because grain can be easily loaded into the container through the open top, and then discharged from the container by opening and closing the gate to discharge just the amount of grain required. Similarly, the invention may be used to transport and place other construction materials besides concrete, such as gravel, peat moss, or other landscaping materials. For example, it is often necessary to place gravel in trenches, which has heretofore been a time consuming and labor intensive activity. With the present invention, gravel can be transported to the trench in the container, the skid steer can be driven so that the skid steer straddles the trench, and the material may be discharged from the container in a controlled manner as the skid steer travels along the trench to place just the correct quantity of gravel in the trench.

These and other advantages of the present invention will become apparent from the following description, with reference to the accompanying drawings, in which.

Figure 1:
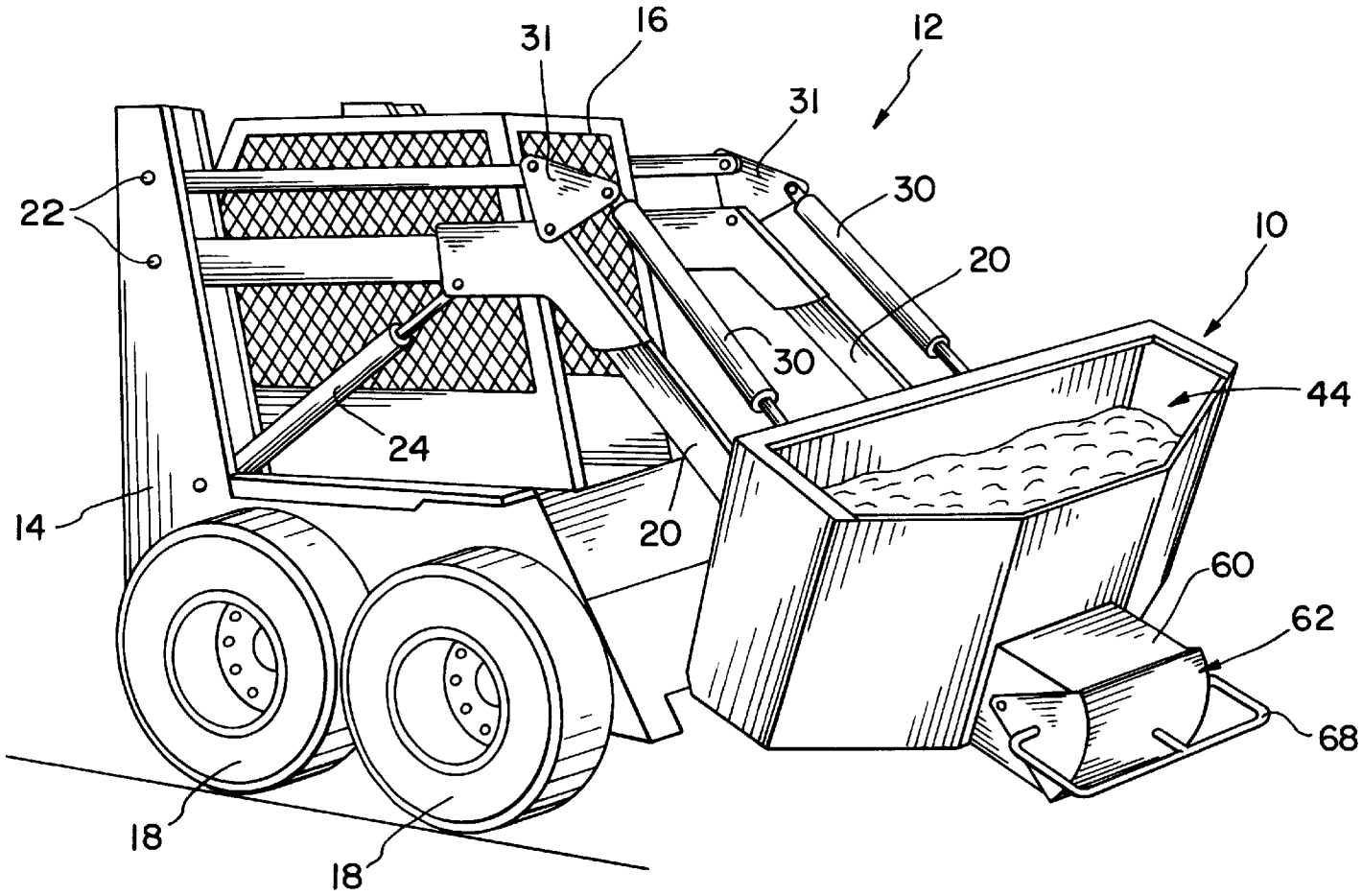
FIG. 1 is a view in perspective of a container according to the present invention mounted on a skid steer loader.
Figure 2:
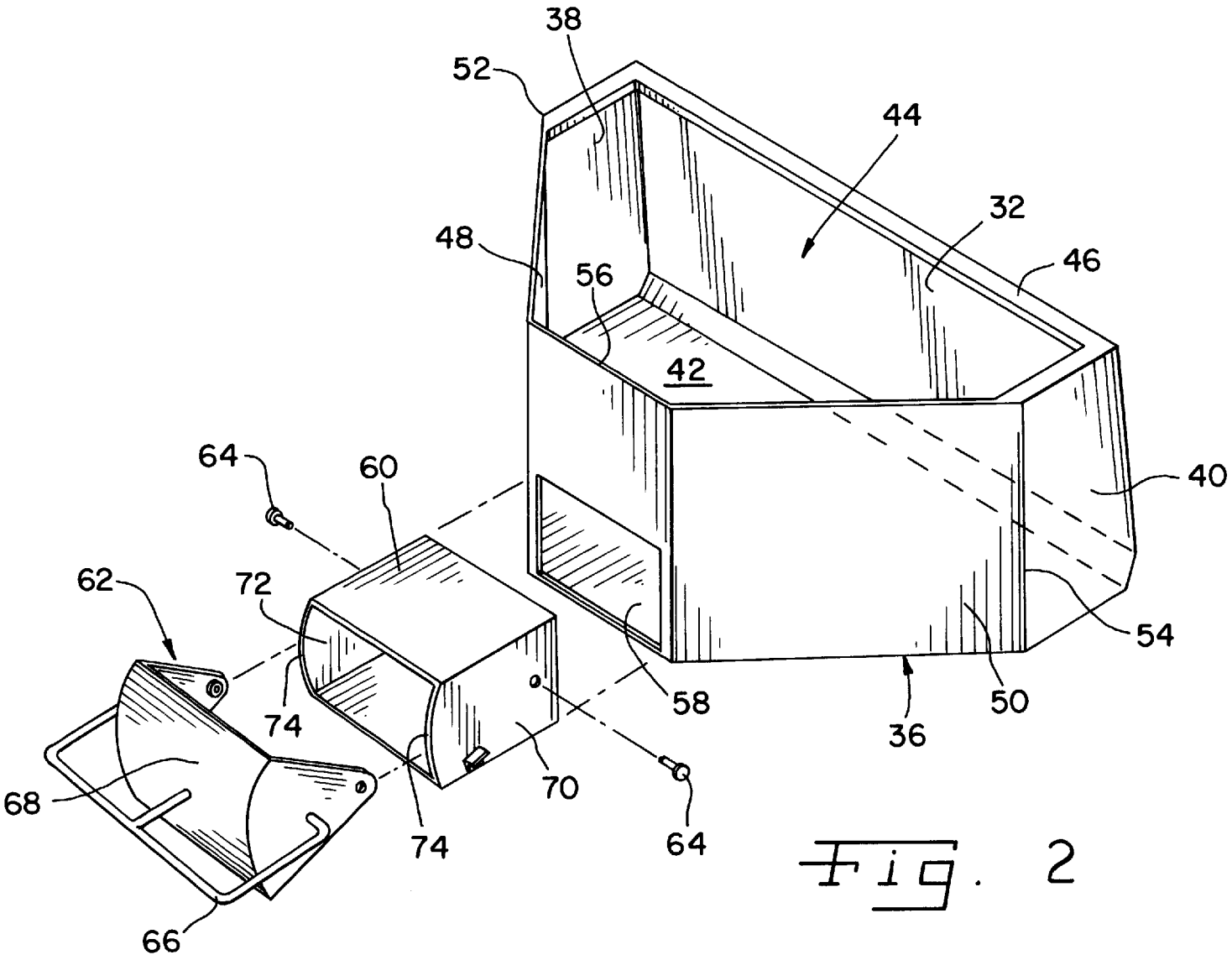
FIG. 2 is an exploded view in perspective of the container pursuant to the present invention.
Figure 3:
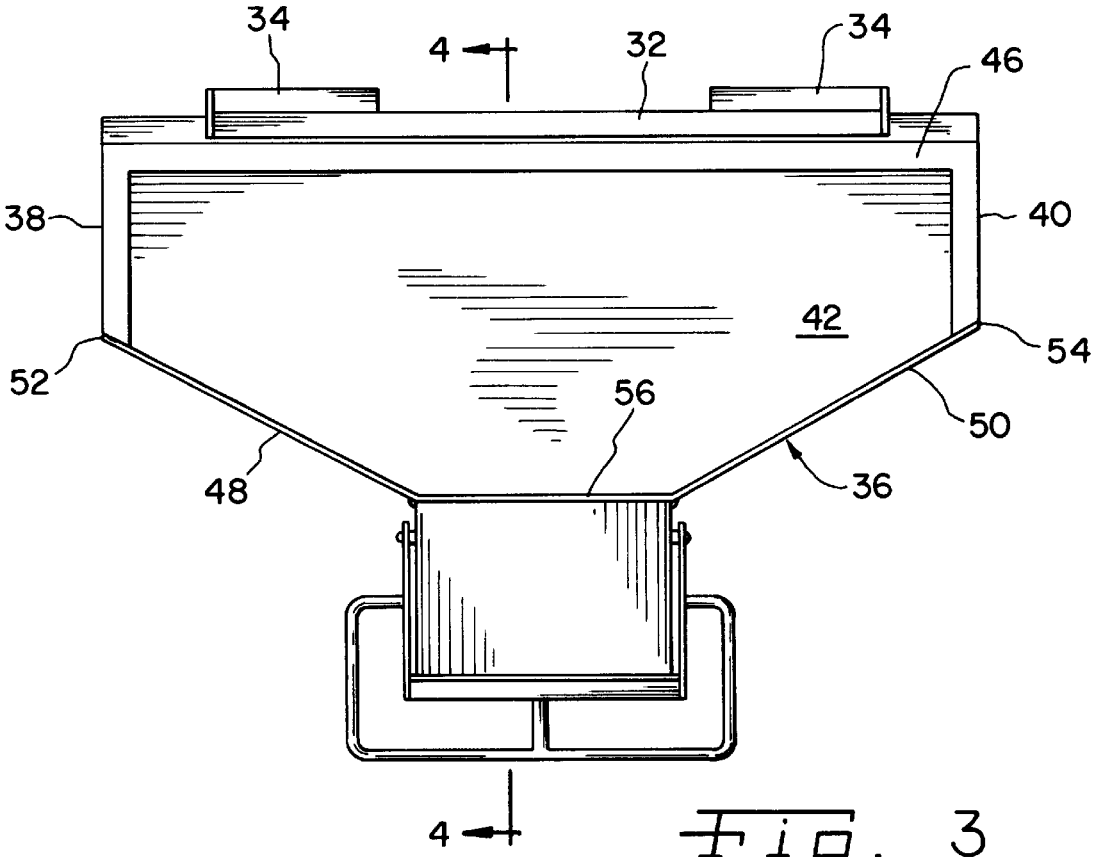
FIG. 3 is a top plan view of the container illustrated in FIGS. 1 and 2.

Referring now to the drawings, a container 10 made according to the present invention is illustrated in FIG. 1 as being attached to a small skid steer loader generally indicated by the numeral 12. The skid steer loader 12 includes a chassis 14 which carries a caged operators compartment 16. The chassis 14 is supported for ground travel by wheels 18. A pair of lift arms 20 are mounted on opposite sides of the chassis 14 by pivots 22 and are raised and lowered about the pivots 22 by hydraulic cylinders 24. The ends of the lift arms 20 opposite the ends connected to the chassis by they pivots 22 are pivotally connected to a mounting plate 26 through pivots 28. Hydraulic cylinders 30 are connected between the mounting plate 26 and gusset plates 31 carried on lift arms 20 and are operable to pivot the mounting plate 26 about the pivots 28.

The container 10 includes a rear wall 32 which carries brackets 34 for attachment to the mounting plate 26 in a conventional manner, a front wall generally indicated by the numeral 36, and a pair of end walls 38, 40 which interconnect the rear wall 32 with the front wall 36. A bottom wall 42 interconnects the walls 32, 36, 38 and 40. Accordingly, the walls 32, 36, 38 and 40 define a fill opening 44 which receives the material to be dispensed from the container 10. In the case of concrete, the opening 44 is sufficiently large that the concrete may be discharged easily from a mixer truck (not shown) into the container 10 through the opening 44. The opening 44 is unobstructed except for an inwardly projecting flange 46 that projects inwardly from the walls 32, 38 and 40 to resist spilling of concrete or similar material out of the container 10 during transport by the skid steer loader 12.

The front wall 36 includes a pair of tapering, converging sections 48, 50 which converge toward one another, from their corresponding intersections of the end walls 38 and 40 indicated at 52 and 54. Front wall 36 further includes a front connecting section 56 which connects the ends of the converging sections 48, 50 opposite the ends 52, 54 thereof. A discharge opening 58 is defined in the connecting portion 56. Accordingly, converging sections 48, 50, connecting section 56, and the discharge opening 58 define a funnel which is a part of the container 10, the outlet of which is the discharge opening 58 and the inlet area is the cross sectional area between the ends 52 and 54 of the converging sections 48, 50. Accordingly, it will be noted that this inlet area is substantially greater than the area of the discharge opening 58. A chute 60 is mounted on the connecting section 56 and extends from the discharge opening 58. A spigot or gate generally indicated by the numeral 62 is pivotally connected to the sides of the chute 60 by pivots 64. A handle 66 is mounted on the gate 62 to permit an operator to open and close the gate as will hereinafter be described. The gate 62 includes a curved front closure plate 68. The chute 60 includes side portions 70 and 72 to which the gate 62 is attached by pivots 64. The ends of the plates 70 and 72 terminate in curved surfaces 74, which have a curvature compatible with that of the curved closure plate 68. Accordingly, the curved surfaces 74 act as a bearing plates supporting the gate 62 as it is opened and closed, thereby substantially reducing the force required to open and close the gate when material is being dispensed from the container 10.

Figure 4:
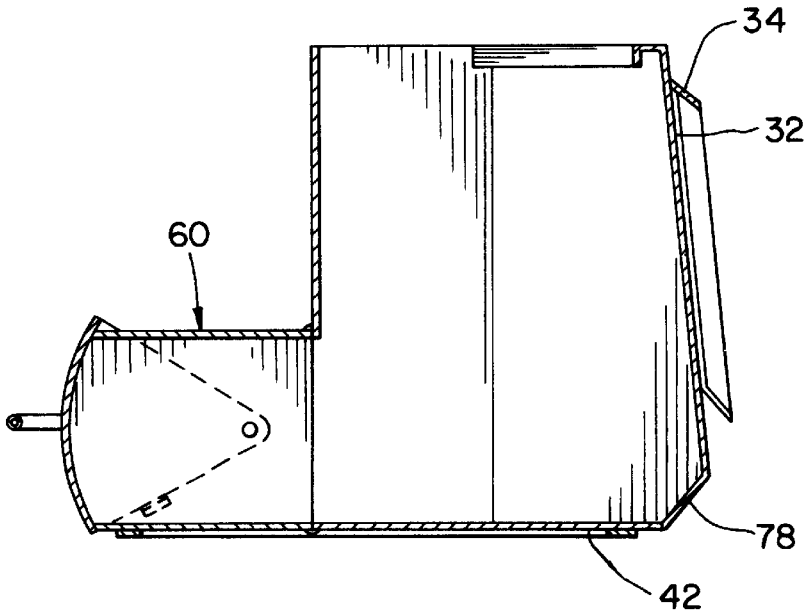
FIG. 4 is a cross sectional view taken substantially along Lines 4—4 of FIG. 3.

Referring to FIG. 4, the rear wall 32 diverges from the front wall 36 as the rear wall 32 extends from the fill opening 44 to the bottom wall 42. The joining edge between the rear wall 32 and the bottom wall 42 is defined by a beveled surface 78. Divergence of the rear side wall 32 and the beveled surface 78 cause the material being dispensed from the container 10 through the chute 60 to flow more evenly through the opening 58, and in the case of concrete, which settles a sit is being transported even short distances, prevents settling from obstructing flow through the dispensing opening 58. The funnel defined by the converging sections 48 and 50 and the dispensing opening 58 directs flow smoothly into the dispensing opening 58. The cross sectional area through the container 10 taken through the edges 52 and 54 is obviously much greater than the cross sectional area of the dispensing opening 58. Accordingly, the weight of the material stored in the container 10, when the container is tilted to cause flow through the opening 58, is concentrated in a direction tending to push flow through the opening 58. Any resistance to flow due to settling of the material for the most part overcome by the weight of the material tending to push the material through the dispensing opening 58. Furthermore, the curved surface 68 of the gate and the curved surface 74 on the ends of the chute 60 tend to act as bearing surfaces such that the gate 62 is easy to pivot between the open and closed position, so that flow through the chute 60 may be readily controlled. This is particularly important in concrete construction, in which it is desirable to be able to immediately stop flow when a form is filled or about to be filled. Concrete generally does not flow evenly, and it is necessary to cut off flow abruptly during concrete placing operations.

Figure 5:
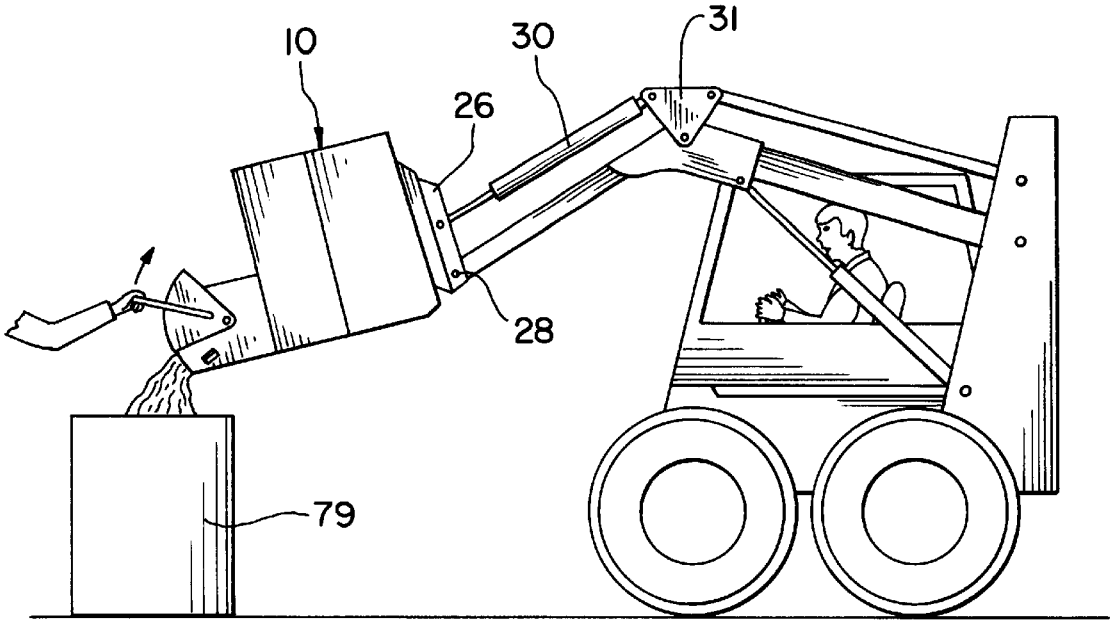
FIG. 5 is a side elevational view of a container and skid steer loader according to the present invention illustrating the manner in which the container can be used to place concrete in a form.
Figure 6:
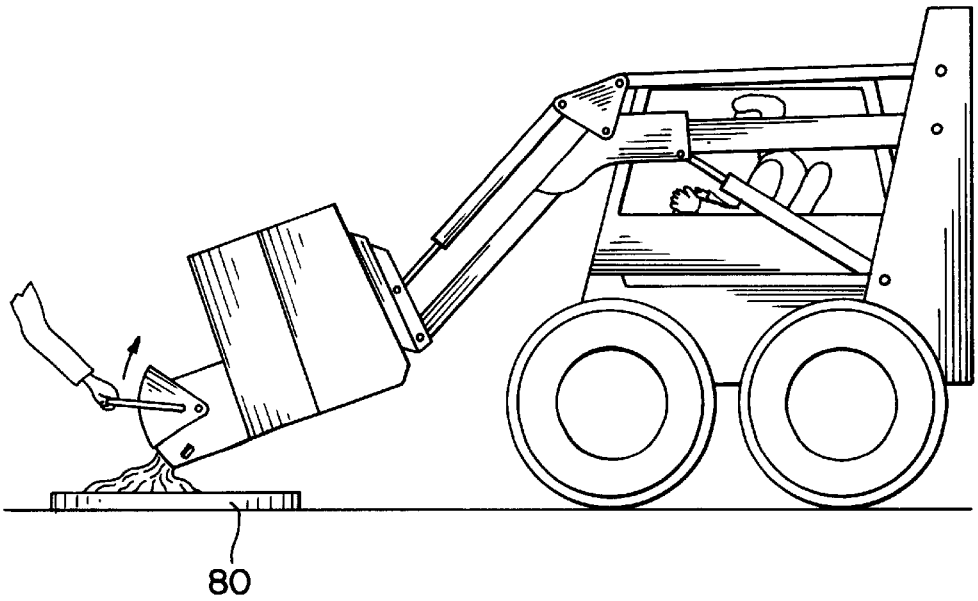
FIG. 6 is a view similar to FIG. 5, but illustrating the manner in which concrete is placed in a low form on the ground.
Figure 7:
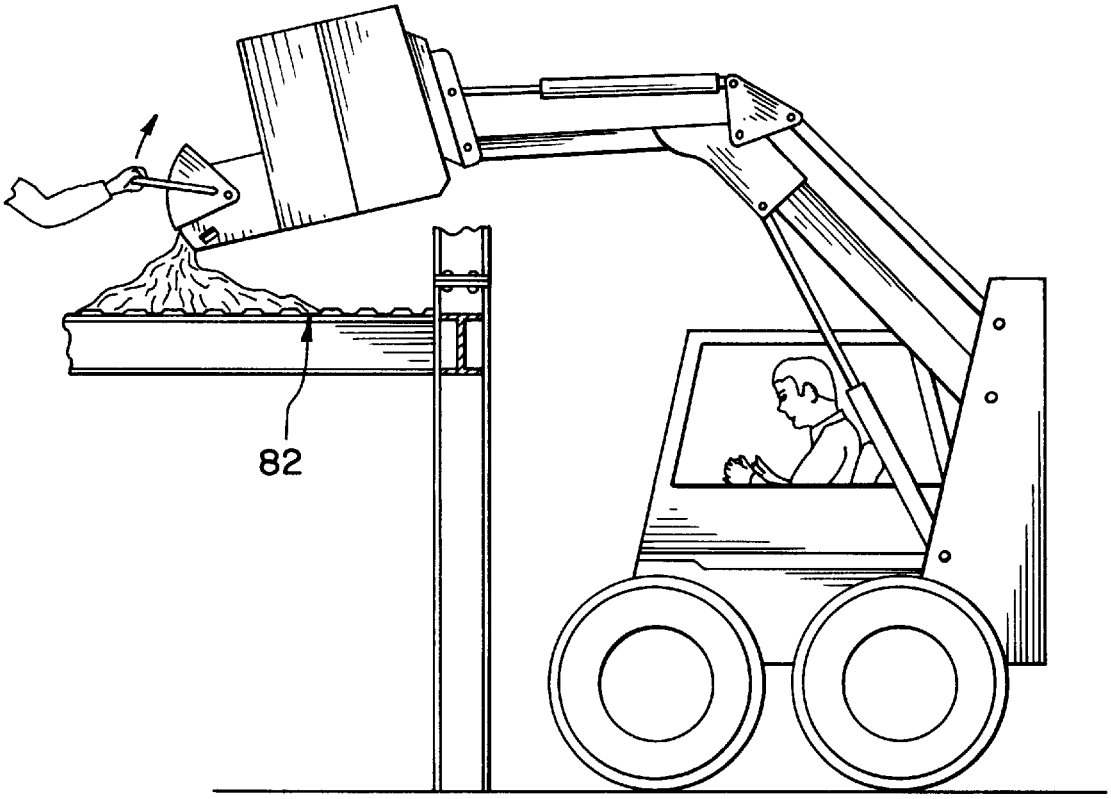
FIG. 7 is a view similar to FIGS. 5 and 6, but illustrating the manner in which concrete can be placed in a high form.

Referring to FIG. 5, concrete is being dispensed from the container 10 into a form 79 of intermediate height. The container 10 is elevated to the position illustrated, and the container 10 is then pivoted around the pivot 28 by use of the hydraulic cylinders 30 to gradually increase the angle of the container 10 with respect to horizonal as concrete is dispensed from the container, thereby assuring even flow. As is known by those skilled in the art, the cylinders 24 which elevate the arms 20 to raise and lower the container 10 have a limited capacity. Accordingly, it is not always possible to use the cylinders 24 to lift the arms 20 when the weight of the concrete or other material being dispensed when the container 10 is full, as the weight of the full container may exceed the greater capacity of the cylinders 24. Accordingly, the container 10 can be elevated to the position illustrated in FIG. 5 before the container is filled, the concrete can be dispensed into the container from a mixer truck through the fill opening 44, and the load transported to the place where the form 78 is located, all without using the cylinders 24 to raise or lower the container. The cylinders 30 can then be used to tilt the container, to thereby properly position the container and to regulate flow out of the container. Similarly, as shown in FIG. 6, the container can be lowered so that the concrete may be dispensed directly into a low form 80. Although it may be difficult to elevate the container with a full load, the container may be used, as illustrated in FIG. 7, to elevate concrete into a high form, such as the form indicated at 82, particularly if only a partial concrete load is dispensed into the container. Care also must be taken when elevating or lowering the container, especially when full of a heavy material such as concrete, because the high center of gravity may cause tipping of the skid steer loader 12.

Although the invention has been described primarily with respect to a container for transporting and dispensing concrete, as also discussed above, other materials may be transported in the container 10. For example, gravel often must be placed in positions which are difficult to access by normal gravel transporting devices, such as dump trucks. Gravel must often be dispensed evenly in trenches or ditches. According to the present invention, gravel may be loaded in the container, and an even strip of gravel may be laid within the trenches by operating the gate 62 by a workman within the ditch or trench. Other landscaping materials, such as peat moss, decorative stone, etc. may be similarly transported by the container 10. Furthermore, livestock feeds, such as grains, may be transported from a central storage facility in the container 10 to animal feeding devices and then dispensed therein.

I claim:

1. Container for transporting and placing flowable material comprising a housing having a rear wall, a bottom wall, a front wall, a fill opening for receiving material deposited into said container, and means mounted on said rear wall for securing said container to a transport vehicle capable of raising and tilting said container, said front wall including converging sections converging toward one another to define a converging portion of said container, a discharge opening defined between said converging sections for discharging material from said container when the container is tilted, and a spigot for controlling flow of said material through said discharge opening, said converging portion including an inlet area between corresponding ends of said converging portions, the cross sectional area of said inlet area being substantially greater than the cross sectional area of said discharge opening whereby the weight of said material in said container acting across said inlet area forces the material through said discharge opening when the container is tilted to discharge the material from the container through said discharge opening, a pair of opposite end walls extending between said rear wall and a corresponding one of said converging sections, said rear wall, said front wall, and said end walls defining said fill opening in said container opposite said bottom wall for receiving said material when the container is filled, said rear wall diverging from said front wall as the rear wall extends from said fill opening to a joining edge joining said rear wall to said bottom wall.

2. Container as claimed in claim 1, wherein said joining edge includes a beveled surface.

* * * * *